United States Patent [19]

Pool

[11] 4,218,027

[45] Aug. 19, 1980

[54] DISPENSER FOR PAPER ROLL

[76] Inventor: Dan L. Pool, 5524 N. 39th Ave., Phoenix, Ariz. 85019

[21] Appl. No.: 972,691

[22] Filed: Dec. 26, 1978

[51] Int. Cl.[2] ..... A47L 10/32

[52] U.S. Cl. ..... 242/55.2

[58] Field of Search ..... 242/55.2, 55.42, 55.54, 242/55.55, 55.53, 55.3

[56] References Cited

U.S. PATENT DOCUMENTS

| | | | |
|---|---|---|---|
| 1,204,810 | 11/1916 | Mercer | 242/55.2 |
| 2,518,328 | 8/1950 | Janonis | 242/55.2 |
| 2,529,420 | 11/1950 | Ramquist | 242/55.2 |
| 2,632,605 | 3/1953 | Lee | 242/55.2 |
| 4,105,168 | 8/1978 | Rutherford | 242/55.2 |

FOREIGN PATENT DOCUMENTS

| | | | |
|---|---|---|---|
| 854025 | 10/1970 | Canada | 242/55.2 |

*Primary Examiner*—George F. Mautz

*Attorney, Agent, or Firm*—Don J. Flickinger

[57] ABSTRACT

A spindle is fixed at one end to a pedestal which projects from the front side of a base. The back side of the base is securable to a vertical or horizontal surface with the spindle being horizontal and extending through the hollow core of a roll of coiled paper sheet. The roll is retained by a projection extending radially from the cap carried at the free end of the spindle. The cap is rotatable to orient projection upwardly regardless of the mounting position of the base.

8 Claims, 9 Drawing Figures

DISPENSER FOR PAPER ROLL

This invention relates to kitchen and bathroom type fixtures.

More particularly, the present invention relates to a dispenser for holding a roll of coiled paper sheet.

In a further aspect, the instant invention concerns a dispenser which can be mounted upon either a vertical or horizontal surface and hold a roll of toilet tissue, paper toweling or other similar paper product.

Many paper products are packaged as rolls of sheet material which are coiled about a hollow core, usually a cardboard tube. Frequently, the sheet is periodically perforated to be readily separated into usable sized units. Exemplary are toilet tissue, paper towels, wrapping paper and wax paper. Metal foil and plastic sheet, especially for domestic use, are similarly packaged and are considered to be analogous.

The prior art is replete with various types of dispensers for holding paper rolls and accommodating use by the consumer. Commonly, the dispensers are in the form of a wall mounted fixture which permits the roll to rotate as a quantity of sheet is uncoiled and drawn from the roll. While such fixtures are located in enumerable locales, primary sites are residential and commercial bathrooms and kitchens.

The prior art has expended considerable effort in an attempt to provide the optimum dispenser for a paper roll, as evidenced by the following U.S. Patents discovered during a search of records in the U.S. Patent and Trademark Office:

U.S. Pat Nos. 154,899 Boord; 2,632,605 Lee; 3,079,099 Blain; 2,393,996 Poirier; 3,672,591 Davis; 2,486,678 Rashko; 230,228 Dupre; 3,482,796 Tucker; 166,534 Grady; 2,472,239 Weller.

The patents issued to Dupre, Rashko, Poirier and Weller illustrate holders having a base from which extends a roll supporting arm. The base is arranged to be attached to a vertical surface with the arm extending horizontally. A stop member is fixed to the free end of the arm and projects upwardly to retain the roll.

A radial flange at the end of the supporting arm retains the roll in accordance with the teachings contained in the patents issued to Blain, Davis, Grady and Tucker. The holders of Blain and Davis incorporate a supporting arm of substantially the same diameter as the core of the roll. Since the radial flange is fixed to the free end of the arm and larger than the opening in the core, it is necessary that the arm be disconnected from the base in order to change rolls. Conversely, the radial flange (disc) of the Tucker device will pass through the core of the roll and the arm is in the form of a reduced diameter dowel. The function of the Grady holder is not ascertainable from the illustration.

The dispenser illustrated in the patent issued to Boord is adapted to be mounted with the arm oriented vertically, thus eliminating the necessity of a roll retention member. The arm, in the patent issued to Lee, is substantially the same diameter as the opening in the core and extends substantially beyond the roll. A spring element, projecting through a slot in the extended portion of the arm, retains the roll. The spring element can be locked in the retention position by the use of a tool.

As will be discussed presently, prior art dispensers include certain inherent limitations.

Accordingly, it is an object of the present invention to provide an improved apparatus for holding and dispensing paper rolls.

Another object of the invention is the provision of a dispenser which can be mounted on variously angled surfaces, such as vertical walls or horizontal shelves.

Still another object of the invention is to provide a dispenser which can be mounted on either a vertical or horizontal wall with the roll supporting arm of the dispenser being horizontal.

Yet another object of the invention is to provide a dispenser in which a single embodiment can be mounted as either a left-handed or right-handed device.

Yet still another object of this invention is the provision of a dispenser having a roll retention member which is positionally adjustable to accommodate the specific mounting orientation.

And, another object of the invention is to provide a dispenser which does not require manipulation of components to change rolls.

And, still another object of the instant invention is the provision of a dispenser which can be installed and made ready for use with conventional tools and usual skills.

A further object of the invention is to provide a dispenser of the type having a relatively large diameter roll supporting arm.

And, a further object of the invention is the provision of a dispenser which can be fashioned to have asthetic appeal.

Still a further object of the invention is to provide a dispenser having a structure which is adaptable to short rolls such as toilet tissue or alternately long rolls, such as paper towels.

And still a further object of the invention is the provision of a dispenser as above, which is relatively economical to manufacture by conventional techniques, durably constructed and maintenance free.

Briefly, to achieve the desired objects of the instant invention in accordance with a preferred embodiment thereof, first provided is a base having a backside which is placed against the surface, wall, shelf or other structure, to which the device is to be attached. A pedestal projects from the front side of the base. A spindle, receivable through the core in the roll, has a fixed end supported by the pedestal and a free end. A cap is rotatably carried at the free end of the spindle and includes a narrow projection extending radially therefrom. Detent means interact between the spindle and the cap for retaining the projection at selectively adjustable angular positions.

The base is mounted upon either a horizontal or vertical surface with the spindle extending horizontally. The cap is then rotated until the projection extends upwardly. The dispenser is not subsequently manipulated. The core of an expended roll is removed by first lifting the core upwardly then withdrawing the core from the end of the spindle. A reverse procedure is used for installing a new roll.

The fixed roll retention member associated with many of the prior art devices, dictates the orientation in which the device may be mounted. Mounting options of right or left-handed, vertical or horizontal, are denied the user. Several of the prior art devices, those having an enlarged spindle with a radial flange at the free end thereof, impose the limitation that the user must manipulate or partially disassemble and re-assemble the apparatus while changing rolls. In accordance with another prior art device, the roll supporting spindle is part of a shelf unit, and the mounting orientation is accordingly limited.

Further and more specific objects and advantages of the instant invention and dissimilarities with the prior art will become immediately apparent to those skilled in the art from the following detailed description of preferred embodiments of the instant invention taken in conjunction with the drawings, in which.

Figure 1:
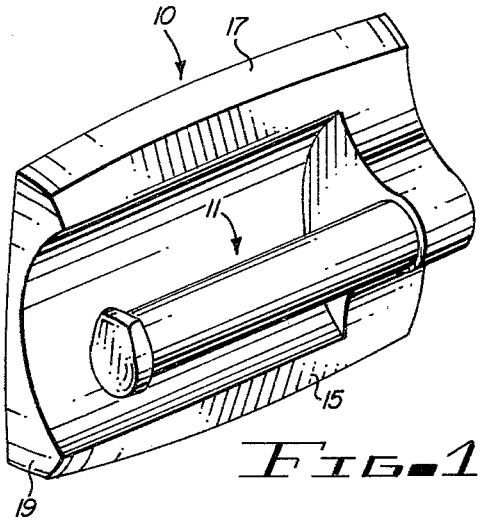
FIG. 1 is a perspective view of a dispenser constructed in accordance with the teachings of the instant invention for holding a roll of coiled paper sheet material.
Figure 2:
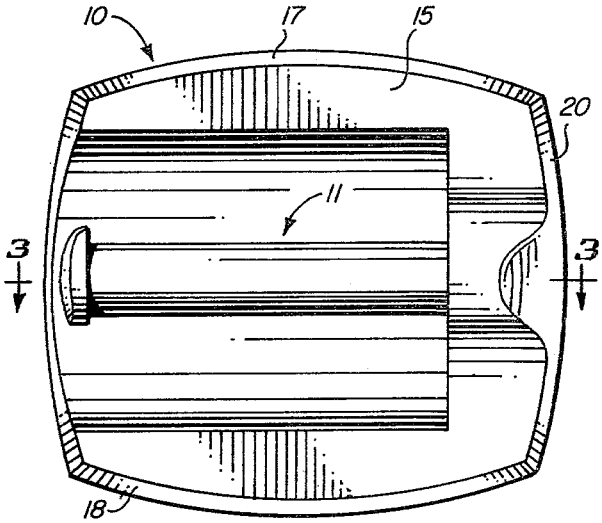
FIG. 2 is a front elevation view of the device of FIG. 1.

Turning now to the drawings, in which like reference numerals indicate corresponding elements throughout the several views, attention is first directed to FIG. 1 which shows a preferred embodiment of the dispenser of the instant invention having a base, generally designated by the reference character 10, and a spindle, generally designated by the reference character 11, for supporting a roll of coiled paper sheet material. Base 10, as further seen in FIGS. 2 and 3, includes a backside 12 which is generally planar and adapted to be placed against surface 13 of structure 14 which is generally representative of a wall, shelf, or other suitable member, as desired by the user. Front side 15 is opposite back side 12. Raised sides 17 and 18 and first end and second ends 19 and 20, respectively, extend between back side 12 and front side 15.

Pedestal 22, having an outer side 23, which in the immediate embodiment is a continuation of second end 20 of base 10, and an inner side 24 projects from front side 15 of base 10. Spindle 11 is generally cylindrical, having an outer surface 25 of substantially constant diameter, a fixed end 27 and a free end 28. Pedestal 22 supports spindle 11 by fixed end 27 so that spindle 11 is generally parallel to back side 12.

Figure 3:
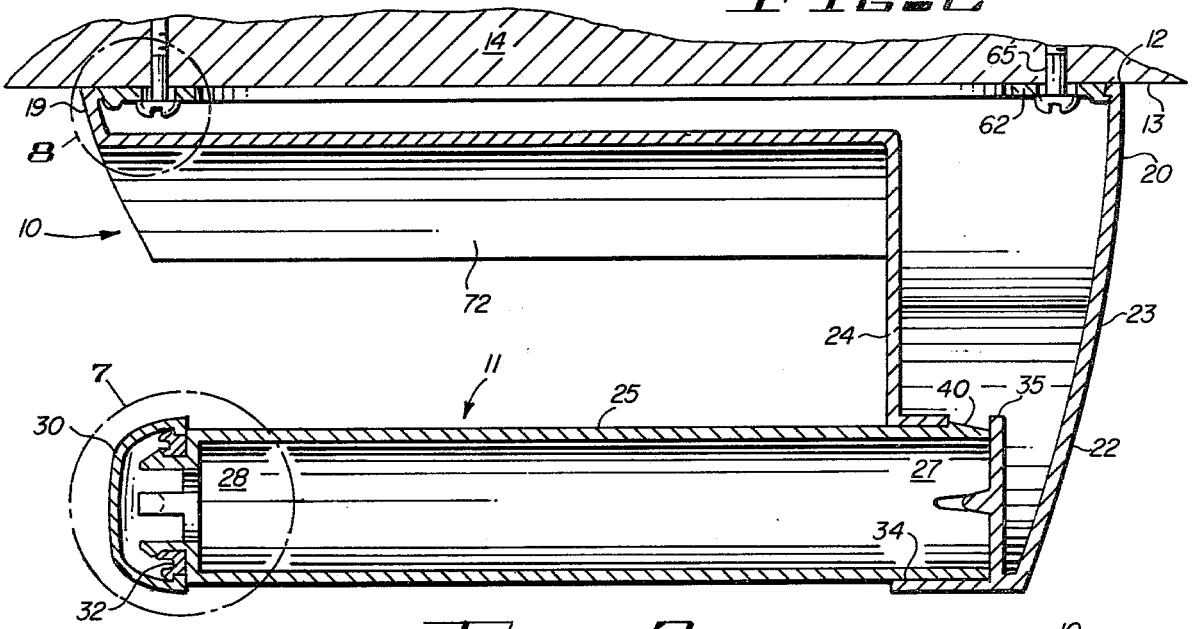
FIG. 3 is an enlarged horizontal sectional view taken along the line 3—3 of FIG. 2.

Preferably, the dispenser is molded as a thin-walled plastic article of suitable plastic, such as the plastic commonly referred to as ABS. As seen in FIG. 3, the device is molded as several independent elements, including base 10, mounting plate 62, spindle 11, cap 30 which, in the preferred embodiment, has a diameter slightly greater than that of spindle 11 and detent ring 32. The several components, except mounting plate 62 are pre-assembled by the manufacturer. It is noted that pedestal 22 is integral with base 10.

Figure 5:
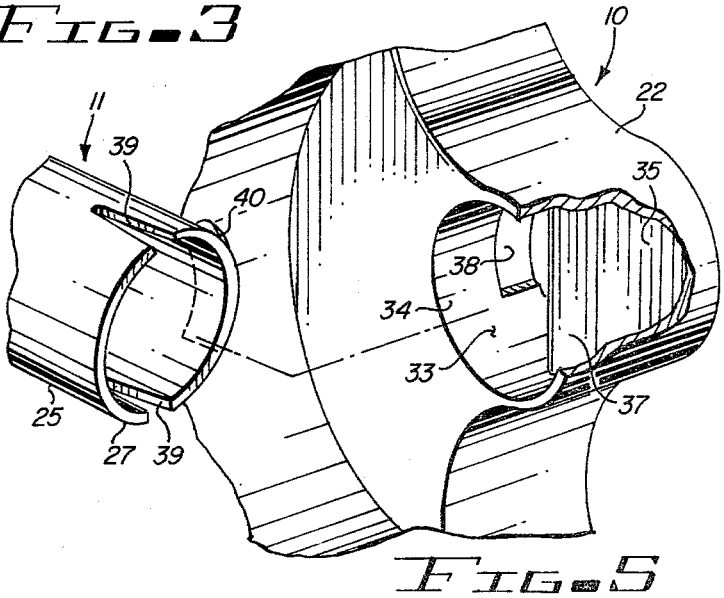
FIG. 5 is an exploded partial perspective view especially illustrating the attachment of the roll supporting spindle to the base.

The attachment of spindle 11 to base 10 is best illustrated in connection with FIGS. 3 and 5. Socket 33, which has a side wall 34 and bottom 35, is formed in pedestal 22. Side wall 34 is sized to closely receive outer surface 25 of spindle 11. Alignment tab 37 projects diametrically across bottom 35. Notch 38 is formed in side wall 34.

Alignment tab 37 is generally V-shaped in cross-section. Groove 39, extending diametrically across fixed end 27 of spindle 11, is V-shaped to matingly receive alignment tab 37. Lug 40, projecting from outer surface 25, is received in notch 38. The engagement of alignment tab 37 within groove 39 prevents relative rotation between spindle 11 and base 10. Lug 40 has a tapered outer surface, such that spindle 11 can be forced into socket 33, deflecting a portion of the spindle inwardly until lug 40 aligns with notch 38. While it is considered that the engagement of lug 40 within notch 38 permanently secures spindle 11 to base 10, it is apparent that a tool, such as a screwdriver, can be entered through back side 12 and used to disengage lug 40 from notch 38.

Figure 4:
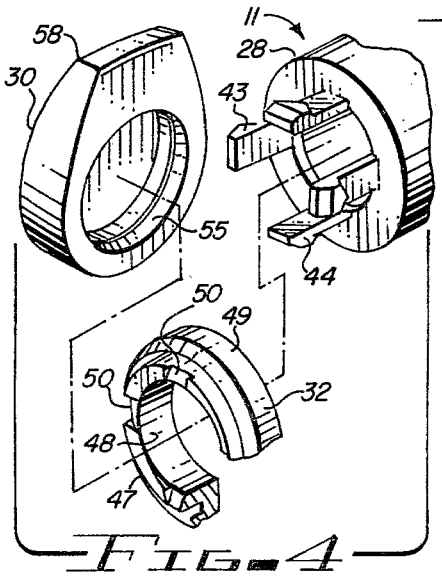
FIG. 4 is an exploded partial perspective view of the end of the roll supporting spindle.
Figure 7:
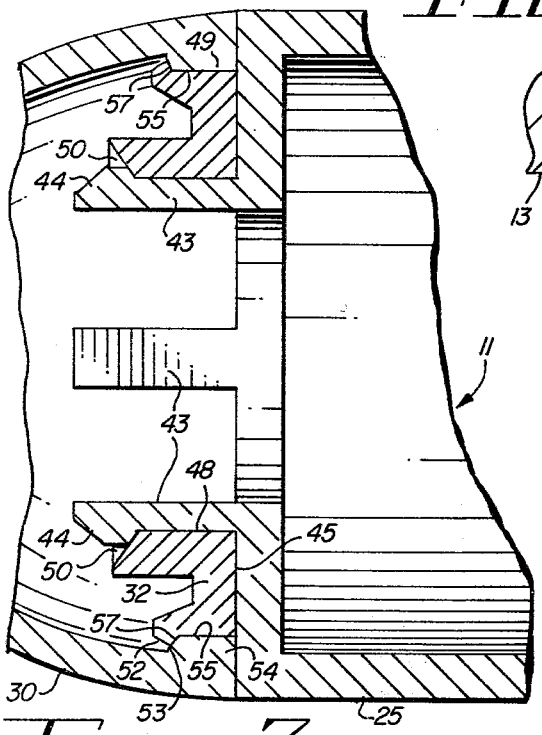
FIG. 7 is an enlarged fragmentary view of that portion of the apparatus within the broken line circle designated 7 in FIG. 3.

Free end 28 of spindle 11 and the components associated therewith are illustrated in detail in FIGS. 3, 4 and 7. Four fingers 43 extend from free end 28 of spindle 11. Preferably, fingers 43 are equally spaced, at 90° increments, about a circle concentric with outer surface 25. An element 44, such as a lug, of a male-female engagement pair is carried by each finger 43 and projects radially outward. Detent ring 32 includes an inner face 45, an outer face 47, an inner cylindrical surface 48 and an outer cylindrical surface 49. Inner cylindrical surface 48 is sized to rotatably encircle fingers 43. Four complemental elements 50, in the form of recesses, of the male-female engagement pair, are formed in outer face 47 of detent ring 32 at equally spaced intervals. In the normal or rest position, inner face 45 of detent ring 32 is abutted against free end 28 of spindle 11 with an element 44 engaged in each complemental element 50.

Annular flange 52 projects from outer cylindrical surface 49 of detent ring 32 and forms shoulder 53. Internal annular flange 54 projecting inwardly from cap 30 includes internal surface 55 and internal shoulder 57. Detent ring 32 is received in snap engagement within cap 30. Concentrically located between cap 30 and detent ring 32 is a junction of mating surfaces 55 and 49, while the engagement of shoulders 53 and 57 secures cap 30 on detent ring 32. A suitable adhesive or bonding agent may also be used to insure the connection between detent ring 32 and cap 30.

An integral projection 58 extends radially from cap 30. The width of projection 58 is not greater than the diameter of cap 30. Elements 44 and complemental elements 50, which comprise the male-female engagement pair, function as detent means and are arranged to hold narrow projection 58 in a selected one of four positions. In two of the positions, 180° apart, projection 58 is parallel to back surface 12 of base 10. In the other two positions, also diametrically opposed, projection 58 is perpendicular to back side 12 of base 10.

In accordance with the foregoing description, it is immediately apparent that base 10 may be mounted upon either a vertical or a horizontal surface with cap 30 turnable on spindle 11 so that projection 58 is oriented upwardly to retain the roll of coiled paper sheet material on spindle 11. Projection 58 is readily rotated by manually grasping and rotating cap 30. It is noted that elements 44 and complemental elements 50 have mating surfaces which are generally V-shaped and beveled. During the initiation of rotation, either clockwise or counter-clockwise, element 44 is urged from complemental element 50 due to the resiliency of the fingers 43. During rotation, element 44 bears against internal cylindrical surface 48 of detent ring 32 and again, due to the resiliency of fingers 43 are biased outwardly to engage the subsequent complemental elements 50.

Figure 6:
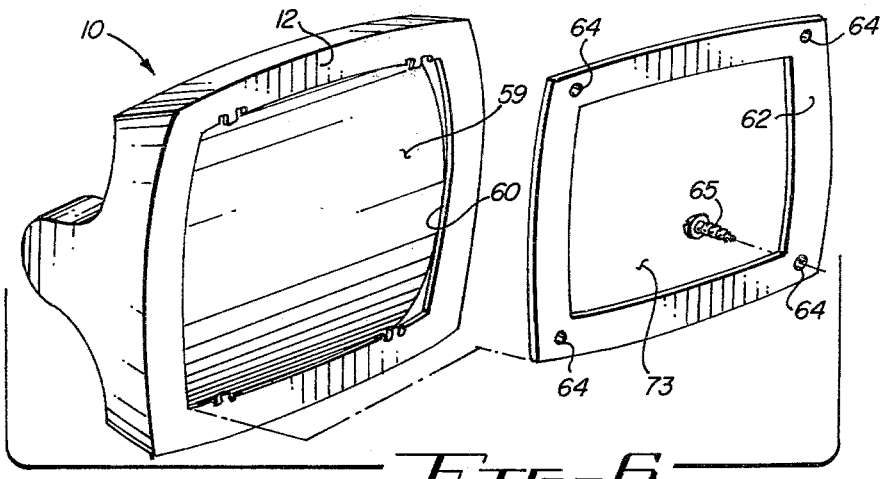
FIG. 6 is an exploded rear perspective view especially illustrating preferred means for attaching the dispenser to a surface.

Referring now to FIG. 6, there is seen a recess 59 having perimetric edge 60 formed in the back side 12 of base 10. In accordance with the immediate embodiment, being of thin-wall construction, recess 59 extends through back side 12. Plate 62 has an outside perimeter 63, which is closely received within edge 60. Openings 64 extending through plate 62 accommodate screws 65 for attaching plate 62 to surface 13 of wall 14.

Figure 8:
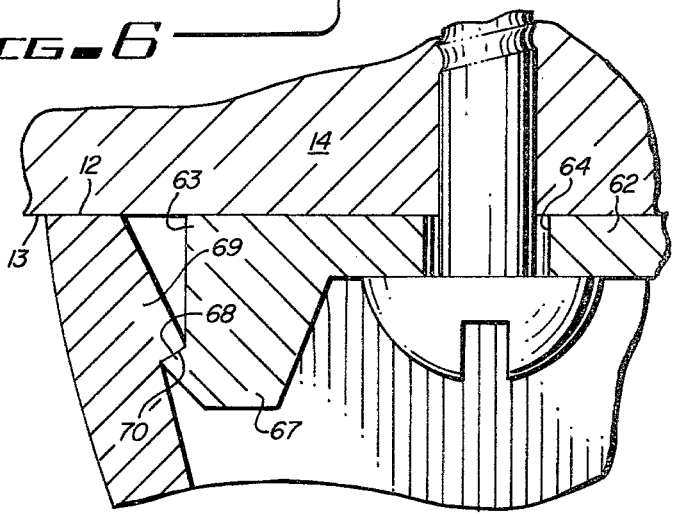
FIG. 8 is an enlarged fragmentary sectional view as designated by the broken line circle 8 in FIG. 3.

Subsequent to attachment of plate 62 to wall 14, base 10 is assembled with plate 62 with back side 12 abutting surface 13, as better seen in FIGS. 3 and 8. In accordance with a preferred embodiment of the invention, engagement between base 10 and plate 62 is by means of snap engagement pairs or snap fasteners. One element of a snap fastener is in the form of a projection 67 extending from plate 62 and having shoulder 68. The other complemental element of the snap engagement pair is a projection 69 carried by base 10 and extending toward recess 59 and having shoulder 70.

It is immediately apparent that the device may be readily and quickly installed by the average homeowner, or other person not specifically skilled in the construction arts, with simply a screwdriver to attach plate 62 to the desired surface. Thereafter, base 10 is aligned with plate 62 and tapped slightly with the hand to affect engagement of each shoulder 68 with a respective shoulder 70. Removal may be affected by wedging a screwdriver between surface 13 and back side 12 and prying upwardly to disassemble the snap engagement. Since the provisions for the attachment of plate 62 to the desired surface is proximate the outer edge thereof, the dispenser of the instant invention may be placed over a previously made opening in the wall, such as might be caused by the removal of a broken or outmoded fixture.

Figure 9:
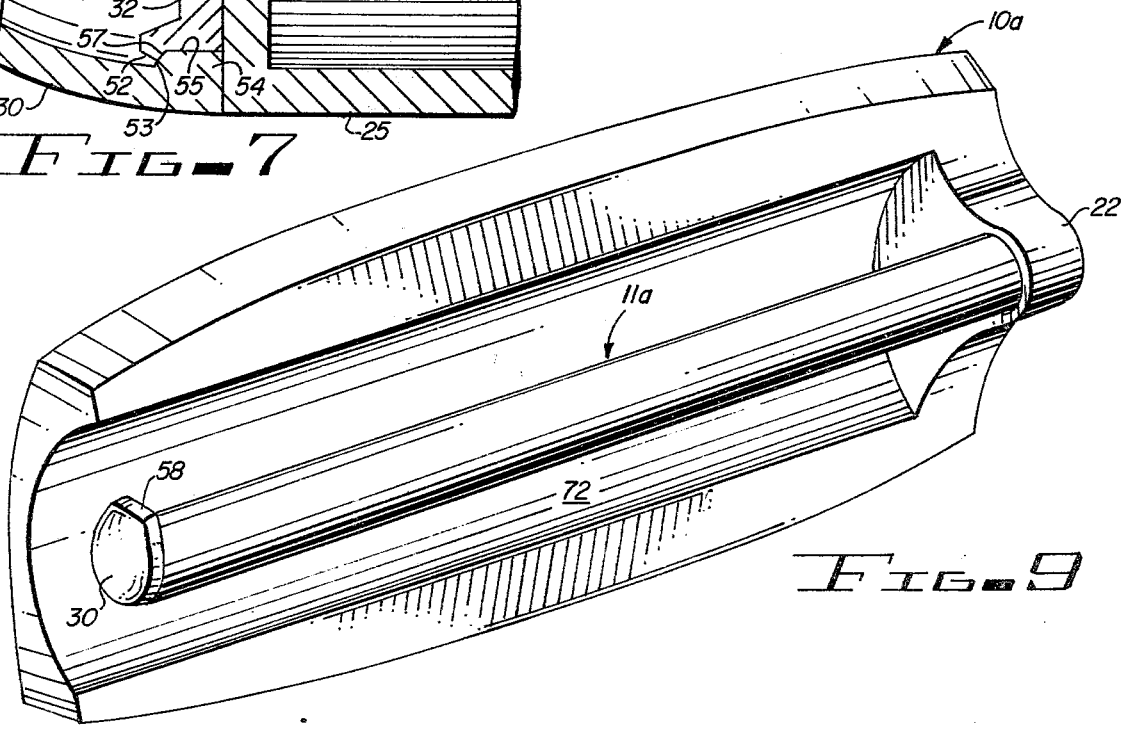
FIG. 9 is a front perspective view of an alternate dispenser constructed in accordance with the teachings of the instant invention.

The embodiment of the invention, as illustrated in FIGS. 1–8, having a relatively short spindle 11, is best suited for short rolls, such as toilet tissue. FIG. 9 illustrates an alternate embodiment of the invention having analogous components with an elongated base **10*a* and an elongated spindle 11*a***. The immediate embodiment is especially adapted for paper towels and other rolls which are substantially longer than the conventional roll of toilet tissue.

In order to present a low profile, placing the spindle in close proximity to the mounting surface, a semicircular recess 72 may be formed in the base to accept the roll. The depth of recess 72 is widely varient. In an extreme, recess 72 may, in fact, project through opening 73 in plate 62 and further into a corresponding opening formed into the mounting surface.

Various changes and modifications to the embodiments herein chosen for purposes of illustration will readily occur to those skilled in the art. For example, in the detent engagement pair, interacting between the free end 28 of spindle 11 and detent ring 32, elements 44 are shown as male, while complemental elements 50 are illustrated as female elements. It is within the scope of the invention that female elements may be carried by fingers 43 and male elements carried by detent ring 32. Further, detent ring 32 may be integral with cap 30. To the extent that such modifications and variations do not depart from the spirit of the invention, they are intended to be included within the scope thereof, which is limited only by a fair assessment of the following claims.

Having fully described and disclosed the invention and alternately preferred embodiments thereof in such clear and concise terms as to enable those skilled in the art to understand and practice the same, the invention claimed is:

1. A dispenser for attachment to a selected surface for holding a roll of coiled paper sheet material having a hollow core, said dispenser comprising:

a. a base having a back side for placement against said surface and a front side;

b. attachment means for securing said base to said surface;

c. a pedestal projecting from the front side of said base;

d. a spindle having a substantially constant diameter receivable through the core in said roll and having a fixed end affixed to said pedestal and a free end;

e. a cap having a diameter slightly greater than the diameter of the spindle rotatably carried at the free end of said spindle and having a projection extending radially therefrom for retaining said roll upon said spindle said projection having a width less than the diameter of said cap; and f. detent means interacting between said spindle and said cap for retaining said projection at predetermined angular positions relative to the spindle.

2. The dispenser of claim 1, wherein said detent means includes:

a. a resiliently movable element of a male-female engagement pair carried by said spindle;

b. a first complemental element of said male-female engagement pair carried by said cap and engageable with said element; and c. a second complemental element of said male-female engagement pair carried by said cap angularly spaced from said first complemental element and alternately engagable with said element.

3. The dispenser of claim 2, wherein:

a. said first complemental element is positioned to retain said projection substantially parallel to the back side of said base; and b. said second complemental element is spaced 90° from said first complemental element to retain said projection substantially perpendicular to the back side of said base.

4. The dispenser of claim 3, further including a third complemental element diametrically opposed to said first complemental element.

5. The dispenser of claim 3, further including a fourth complemental element diametrically opposed to said second complemental element.

6. The dispenser of claim 1, further including a recess in the back side of said base for receiving said plate whereby the back side of said base is received against said surface.

7. The dispenser of claim 1, wherein said spindle is separable from said base and said dispenser further includes:

a. a socket in said pedestal for receiving the fixed end of said spindle;

b. engagement means interacting between said spindle and said pedestal for retaining said fixed end within said socket; and c. positioning means interacting between said socket and said fixed end for orienting the spindle relative to the back side of said base.

8. The dispenser of claim 1, in which, the attachment means includes:

a. a plate securable to said surface; and b. snap fastening means for removably attaching the plate to the base, said snap fastening means including a plurality of first projections on said plate each first projection having a first shoulder; and a plurality of second projections on said base, each second projection having a second shoulder, said first and second projections being complemently positioned so that when the first and second shoulders are forced into contact with each other, the base is removably attached to the plate.

* * * * *